US007121908B2

(12) United States Patent
Okuyama

(10) Patent No.: US 7,121,908 B2
(45) Date of Patent: Oct. 17, 2006

(54) CONTROL SYSTEM FOR WATERCRAFT PROPULSION UNITS

(75) Inventor: Takashi Okuyama, Shizuoka-ken (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/187,136

(22) Filed: Jul. 22, 2005

(65) Prior Publication Data

US 2006/0019552 A1 Jan. 26, 2006

(30) Foreign Application Priority Data

Jul. 22, 2004 (JP) ..... 2004-214417

(51) Int. Cl.
*B63H 21/22* (2006.01)

(52) U.S. Cl. ..... 440/84; 701/21

(58) Field of Classification Search ..... 440/1, 440/2, 84, 85, 86, 87; 701/21, 36
See application file for complete search history.

(56) References Cited

U.S. PATENT DOCUMENTS 4,836,809 A * 6/1989 Pelligrino ..... 440/2
5,080,619 A * 1/1992 Uchida et al. ..... 440/84
5,094,122 A * 3/1992 Okita ..... 440/87
6,485,340 B1 * 11/2002 Kolb et al. ..... 440/84
6,587,765 B1 7/2003 Graham et al.
2003/0204291 A1 10/2003 Graham et al.
2004/0209731 A1 10/2004 Graham et al.

OTHER PUBLICATIONS

Catalogue for Shift and Throttle Lever Product Catalogue for Three-Unit Engines, I600 Series. Published by Teleflex Morse Corp. (USA).

* cited by examiner

*Primary Examiner*—Lars A. Olson
(74) *Attorney, Agent, or Firm*—Knobbe, Martens, Olson & Bear, LLP

(57) ABSTRACT

A watercraft control system is provided in which shift and thrust of outboard motors can be controlled through adjacent two operating levers in the watercraft having three or more outboard motors mounted in parallel on a transom plate. The control system can be provided with a control circuit for detecting lever positions of the operating levers and controlling the left unit according to the lever position of the left operating lever and the right unit according to the lever position of the right operating lever. The control circuit can be provided with a calculation circuit for calculating an imaginary lever position of the middle unit from the lever positions detected.

9 Claims, 13 Drawing Sheets

CONTROL SYSTEM FOR WATERCRAFT PROPULSION UNITS

PRIORITY INFORMATION

This application is based on and claims priority under 35 U.S.C. §119 to Japanese Patent Application No. 2004-214417, filed on Jul. 22, 2004, the entire contents of which is hereby expressly incorporated by reference herein.

BACKGROUND OF THE INVENTIONS

1. Field of the Inventions

The present inventions relate to a control system for watercraft propulsion units and particularly to a watercraft control system having three or more watercraft propulsion units disposed in parallel in a hull.

2. Description of the Related Art

Some watercraft can have three outboard motors mounted on a transom thereof, in a side-by-side arrangement. Conventionally, such watercraft incorporate three sets of shift and throttle levers, each of which corresponds to a respective outboard motor. However, it can be a burden for the operator to operate six shift and throttle levers in addition to operating a steering device.

Recently, an improved control device for a watercraft that can control the entire shift and throttle operations of three outboard motors with two levers disposed transversely next to each other has been suggested. For example, the i6000 series, shift/throttle lever for three outboard motors, available from the Teleflex Morse Co., Ltd. (USA) is such a device.

Using such a device, the operator can control operations of the outboard motor located on the right hand side (hereinafter called "starboard side outboard motor") using the lever positioned on the starboard side, while the operator controls operations of the outboard motor located on the left hand side (hereinafter called "port side outboard motor") using the lever positioned on the port side. The outboard motor centrally located between the starboard side outboard motor and the port side outboard motor is controlled in accordance with operational conditions of the starboard side outboard motor and the port side outboard motor. That is, if the starboard side outboard motor or the port side outboard motor is controlled to be in a forward mode and the other one of those motors is controlled to be in a reverse mode, the center outboard motor is controlled to be in a neutral mode. If both of the motors are controlled to be in the same mode, the center outboard motor is also controlled to be in the same mode and in the same throttle opening as those of the starboard side outboard motor or the port side outboard motor.

During operation, however, an operator may decide to turn either leftwardly or rightwardly while advancing (or reversing). In other situations, for example in tight spaces in a marina or when moving a watercraft alongside a wharf or dock, an operator may attempt to turn at slow speed, without moving forwardly or rearwardly, ("turning round on the spot"). In some cases, "turning round on the spot" is performed while a greater thrust is applied for the advancing or reversing, to cancel wind drift of the watercraft.

However, in such a case, since in the foregoing operating device, the central outboard motor is set in neutral or operates in the same way as either the left or the right outboard motor. Thus, the central outboard motor either interferes with the desired maneuver, or it is not used efficiently. For example, if either of the left and the right outboard motor is driven for advancing and the other for reversing to effect turning of the hull, the central outboard motor is set in neutral unconditionally, so that the central outboard motor cannot be used effectively in response to the conditions, for example, of turning round in advancing or reversing.

Also, if both of the left and right outboard motors have thrusts in the same direction but different in magnitude, since the central outboard motor is driven to be suited to one of the left and right outboard motors, an awkward feeling may be given or unnecessary thrust may be generated. In some cases, against the thrust on the side of the left unit (or the right unit) increased by the central outboard motor, the other outboard motor or the right unit (or the left unit) is required to generate a larger thrust, to counterbalance the turning moment which affects the moving direction of the watercraft

SUMMARY OF THE INVENTIONS

An aspect of at least one of the embodiments disclosed herein includes the realization that a middle outboard motor can be controlled so as to operate at an averaged speed or to generate an averaged thrust of the outer outboard motors. As such, the outboard motor is utilized efficiently, reducing the time it operates in neutral, and can prevent awkward feelings that result from prior art control systems.

Thus, in accordance with an embodiment, a watercraft control system for controlling shift and thrust of watercraft propulsion units through first and second adjacent operating levers in a watercraft having at least a left-most propulsion unit, a right-most propulsion unit, and at least an intermediate propulsion unit disposed between the right-most and the left-most propulsion units is provided. The control system can comprise a control device configured to detect positions of the first and second operating levers. The controller can also be configured to control the operation of the left-most propulsion unit in response to the lever position of the first lever, and to control the operation of the right-most propulsion unit in response to the lever position of the second lever. The control device can include a calculation module for calculating, from the detected lever positions, imaginary lever positions of the intermediate watercraft propulsion units between the left and the right units.

In accordance with another embodiment, a watercraft control system for controlling shift and thrust of watercraft propulsion units through first and second adjacent operating levers in a watercraft having a left-most propulsion unit, a right-most propulsion unit, and at least an intermediate propulsion unit disposed between the right-most and the left-most propulsion units can be provided. The control system can comprise control means for detecting lever positions of the first and second operating levers, controlling the left-most propulsion unit in response to the position of the first lever, and controlling the right-most unit in response to the position of the second operating lever. The control device can be provided with calculation means for calculating, from the detected lever positions, imaginary lever positions of the intermediate watercraft propulsion units between the left and the right units.

In accordance with yet another embodiment, a watercraft control system for controlling shift and thrust of watercraft propulsion units through first and second adjacent operating levers in a watercraft having a left-most propulsion unit, a right-most propulsion unit, and at least an intermediate propulsion unit disposed between the right-most and the left-most propulsion units can be provided. The control system can comprise a control device configured to detect lever positions of the first and second operating levers, to control the left-most propulsion unit in response to the position of the first lever, and to control the right-most unit in response to the position of the second operating lever. The control device can include a calculation device configured to detect a thrust of the left-most unit and a thrust of the right-most unit and to calculate, from the detected thrusts of the left-most and right-most units, target thrusts of the intermediate propulsion unit between the left unit and the right unit thrusts.

In accordance with a further embodiment, a watercraft control system for controlling shift and thrust of watercraft propulsion units through first and second adjacent operating levers in a watercraft having a left-most propulsion unit, a right-most propulsion unit, and at least an intermediate propulsion unit disposed between the right-most and the left-most propulsion units can be provided. The control system can comprise control means for detecting lever positions of the first and second operating levers, controlling the left-most propulsion unit in response to the position of the first lever, and controlling the right-most unit in response to the position of the second operating lever. The control means can include calculation means for detecting a thrust of the left-most unit and a thrust of the right-most unit and calculating, from the detected thrusts of the left-most and right-most units, target thrusts of the intermediate propulsion unit between the left unit and the right unit thrusts.

BRIEF DESCRIPTION OF THE DRAWINGS

The above-mentioned and other features of the inventions disclosed herein are described below with reference to the drawings of the preferred embodiments. The illustrated embodiments are intended to illustrate, but not to limit the inventions. The drawings contain the following Figures.

DETAILED DESCRIPTION OF THE PREFERRED EMBODIMENT

Figure 1:
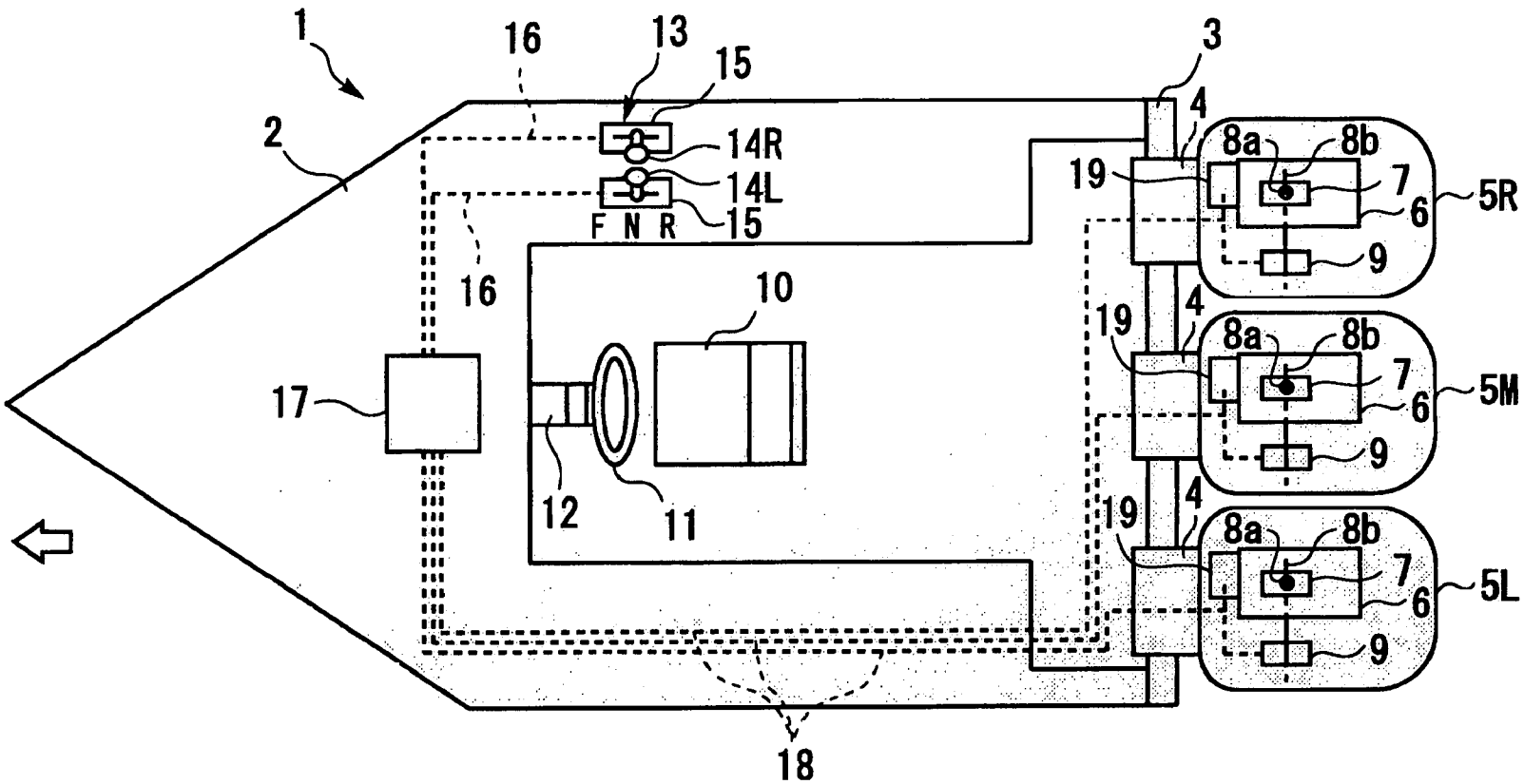
FIG. 1 is a schematic top plan view of a watercraft that incorporates a control device configured in accordance with an embodiment.

FIG. 1 is a schematic top plan view of a small watercraft 1 including a control device configured to operate three outboard motors. The embodiments disclosed herein are described in the context of a marine propulsion system of a watercraft because these embodiments have particular utility in this context. However, the embodiments and inventions herein can also be applied to other marine vessels, such as personal watercraft and small jet boats, as well as other vehicles.

With reference to FIG. 1, some embodiments of the watercraft 1 can include three watercraft propulsion units mounted on the hull. As shown in the figure, the watercraft 1 includes a hull 2 and three watercraft propulsion units (outboard motors 5L, 5M, 5R in this example) mounted to a transom plate 3 through clamping brackets 4. For the convenience of description, the outboard motor located on the left side with respect to the advancing direction of the watercraft shown by the white arrow is referred to as a left unit 5L, the outboard motor located on the right side as a right unit 5R, and the outboard motor located therebetween as a middle unit 5M.

Each of the outboard motors 5L, 5M, 5R can have an engine 6. In order to adjust the amount of intake air of the engine 6, and thus to control the engine speed or the output torque of the engine 6, the intake system of the engine 6 is provided with a throttle body 7 (or a carburetor).

The throttle body 7 can be provided with an electric throttle valve 8*a*. A valve shaft 8*b* of the throttle valve 8*a* can be connected to a motor 9. The throttle valve 8*a* can be opened and closed by the motor 9 driven through electronic control. In front of a driver's seat 10 in the hull 2, a manually operated steering wheel 11 for the steering of the watercraft 1 can be provided. The steering wheel 11 can be attached to the hull 2 through a steering wheel shaft 12.

To the side of the driver's seat 10, a controller (remote controller) 13 can be provided for controlling operations of the outboard motors 5L, 5M, 5R. The controller 13 can be provided with a left remote control lever 14L located on the left side with respect to the advancing direction of the watercraft and a right remote control lever 14R located on the right side with respect to the advancing direction of the watercraft. Additionally, potentiometers 15 can be configured to detect lever positions of the remote control levers 14L, 14R.

During operation, the operator can operate the controller 13 to change the shift of the engine 6 of the outboard motors 5L, 5M, 5R and adjust opening of the respective throttle valves 8*a*, so as to perform thrust control of the watercraft 1 including adjustment of the traveling speed and acceleration or deceleration. The left remote control lever 14L can be provided for the shift change of the left unit 5L and opening adjustment (thrust control) of the throttle valve 8*a*, and the right remote control lever 14R is provided for the shift change of the right unit 5R and opening adjustment (thrust control) of the throttle valve 8*a*.

Figure 2:
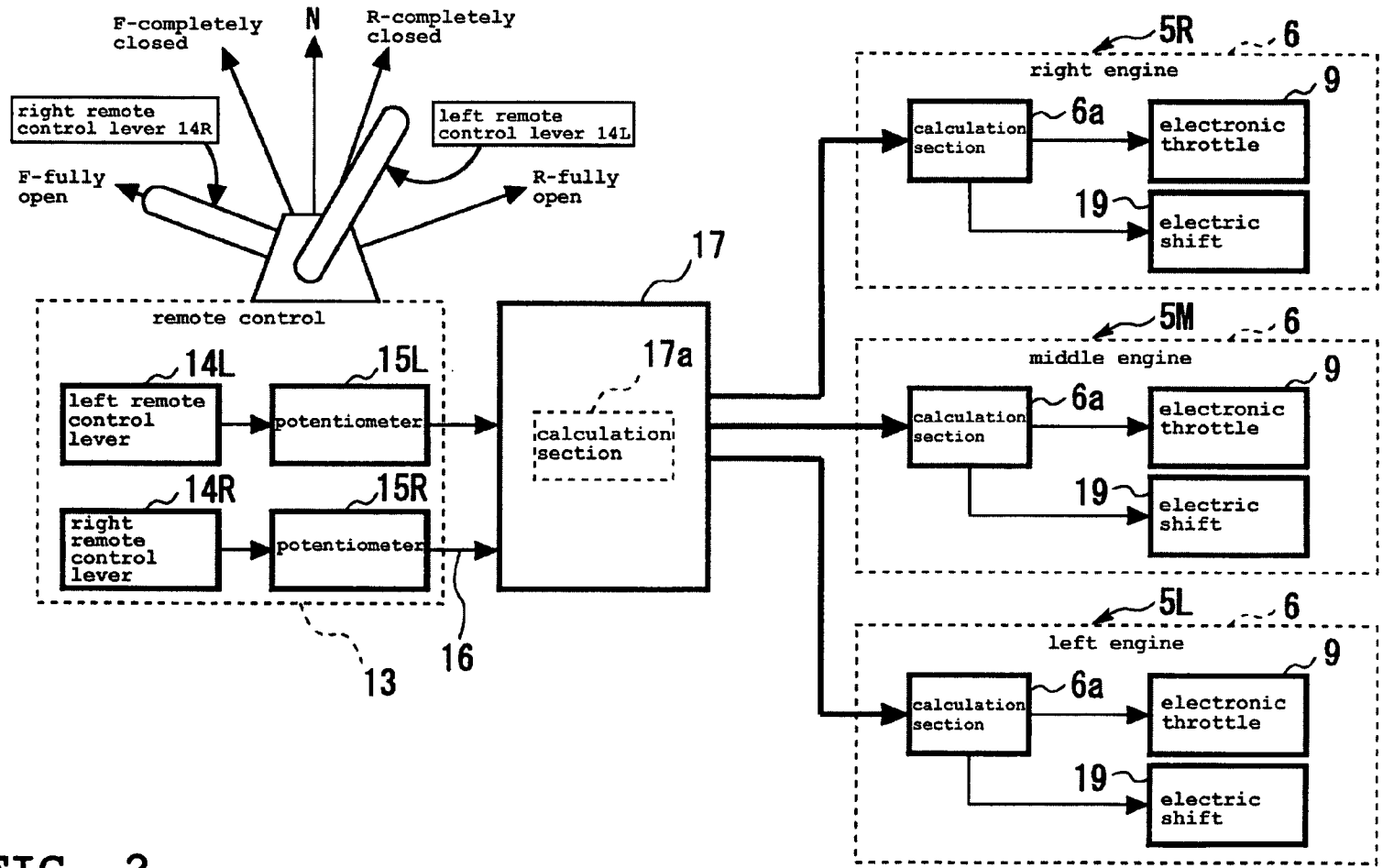
FIG. 2 is a block diagram of the control device that can serve as the control device incorporated into the watercraft of FIG. 1.

With reference to FIG. 2, the controller 13 can be configured such that when the levers 14L, 14R are each in a middle position, the gear position of the engine 6 is set to neutral (N). If the levers 14L, 14R are each pushed forward further than that position, the gear position is changed to the forward (F). Additionally, if the levers 14L, 14R are each pulled rearward further than the neutral position, the gear position is changed to the reverse (R).

If the levers 14L, 14R are each pushed further forward in the forward (F) shift condition, the respective throttle valves 8*a* open gradually from the F-completely closed position to the F-fully open position. If the levers 14L, 14R are each pulled further rearward in the reverse (R) shift condition, the respective throttle valves 8*a* open gradually from the R-completely closed position to the R-fully open position. Thus, the operator can perform thrust control by opening/closing the throttle valves 8*a* at the time of advancing and reversing.

The controller 13 can be connected to a control circuit 17 through signal cables 16. The control circuit 17 can be configured to receive information on the lever positions of the remote control levers 14L, 14R output from the potentiometers 15 after a given calculation. The outboard motors 5L, 5M, 5R and the control circuit 17 can be connected through signal cables 18. Switching between advancing and reversing, and gear shift changes can be performed through electric shift mechanisms 19 provided in each of the engines 6.

The hull 2 can be provided with a steering driving device (not shown) for rotating the outboard motor about a swiveling shaft (not shown) according to the operation angle of the manually operated steering wheel 11.

FIG. 2 is a block diagram of the operating device that can comprise the controller 3, the control circuit 17 and the outboard motors 5L, 5M, 5R. In FIG. 2, if the left and right levers 14L, 14R are each in the neutral position N, and then are pushed forward so as to be moved into the forward gear position (F) at F-completely closed position, all of the outboard motors 5L, 5M, 5R operate at idle speed, and thus turn their respective propellers at idle engine speed. The levers can also be pushed further forward, into maximum throttle opening at F-fully open position. The same is applied in the case of reversing (R). Thus, the gear positions of all the outboard motors 5L, 5M, 5R are neutral in the region from F-completely closed position to R-completely closed position.

The lever position of the left remote control lever 14L of the controller 13 can be detected by a potentiometer 15L provided corresponding to the remote control lever 15L, and its positional information is input to a calculation section 17*a* of the control circuit 17. Likewise, the lever position of the right remote control lever 14R can also be detected by a potentiometer 15R, and its positional information is inputted to a calculation section 17*a* of the control circuit 17.

The calculation section 17*a* can be configured to calculate drive signals for an electronic throttle (that is, motor 9) and the electric shift mechanism 19 in the left unit 5L, based on the input positional information of the left remote control lever 14L, and to output the drive signals. Likewise, drive signals for an electronic throttle (that is, motor 9) and the electric shift mechanism 19 in the right unit 5R can be calculated based on the input positional information of the right remoter control lever 14R to be output.

Further, the calculation section 17*a* can be configured to calculate a target value of the shift and thrust of the engine of the middle unit 5M according to the various predetermined relationships (described below), and to output drive signals of the target value from the control circuit 17 to the electronic throttle (that is, motor 9) and the electric shift mechanism 19. The engine 6 of each outboard motor 5L, 5M, 5R can be provided with a calculation section 6*a* for transforming an output signal from the control circuit 17 into drive signals for the electronic throttle 9 and the electric shift mechanism 19.

The shift position and the thrust for each outboard motor 5L, 5M, 5R can be calculated by the respective calculation section 6*a*. In this case, the control circuit 17 on the remote controller side can be configured to send only the positional information of the remote control lever to the calculation section 6*a* of each outboard motor 5L, 5M, 5R. An exemplary method for setting the target value of the engine control of the middle outboard motor 5M is described below.

Figure 3:
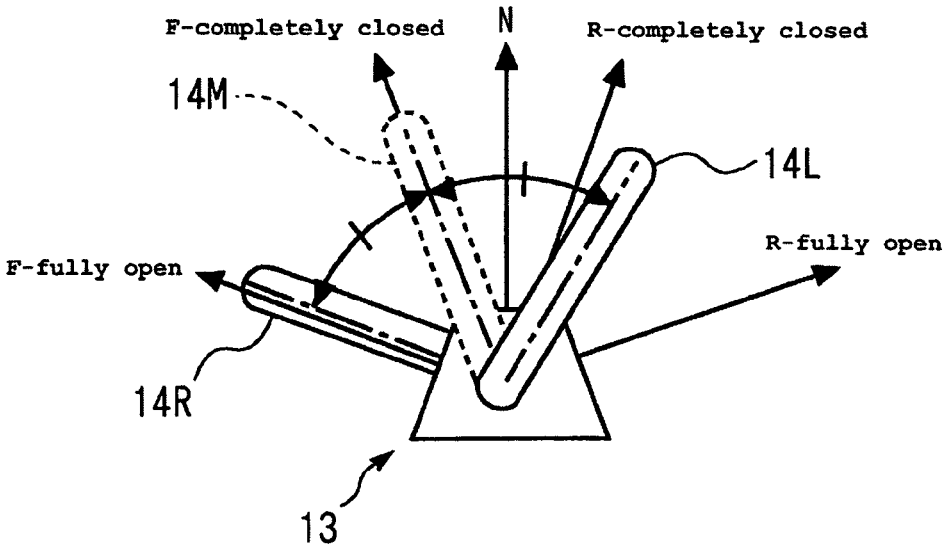
FIG. 3 is a schematic side elevational view of a controller that can be used with the control device of FIGS. 1 and 2.
Figure 4:
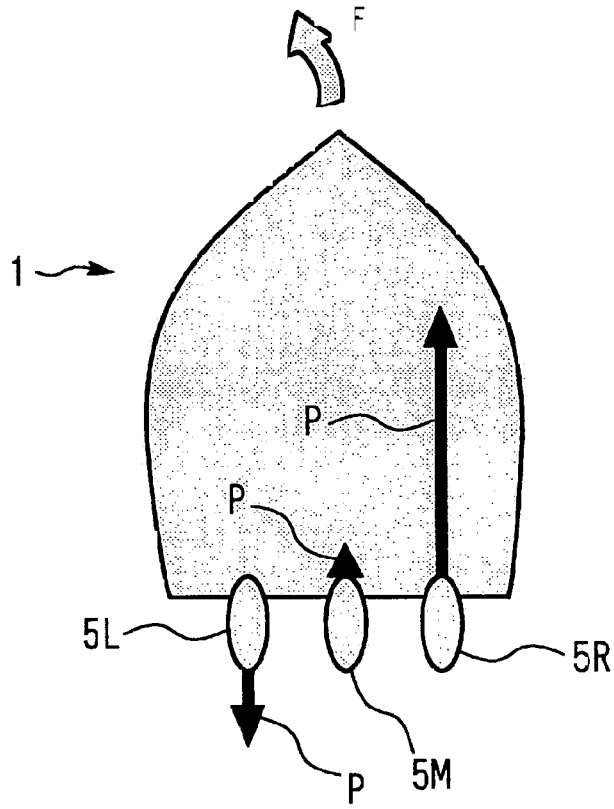
FIG. 4 is a schematic top plan view of the watercraft illustrating an exemplary but non-limiting operation thereof.

FIG. 3 and FIG. 4 illustrate exemplary methods for operating the controller 13 in embodiments for a watercraft provided with three outboard motors controlled by the controller 13. The lever shown in FIG. 3 by a dotted line is an imaginary remote control lever 14M assumed as a control device of the operation of the middle unit 5M, based on the positions of the left and right remote control levers 14L, 14R.

With reference to FIG. 2, the control circuit 17 can be configured to read the lever positions of the left and right remote control levers 14L, 14R. Additionally, the control circuit 17 can be configured to output to the engine 6 of the left unit 5L, a drive signal corresponding to the lever position of the remote control lever 14L. The control circuit 17 can also be configured to output to the engine 6 of the right unit 5R, a drive signal corresponding to the lever position of the remote control lever 14R.

In addition, in some embodiments, the middle point of the space between the foregoing positions of the levers 14L, 14R is calculated in the calculation section 17*a* of the control circuit 17 and a drive signal corresponding to the foregoing middle position calculated is output to the calculation section 6*a* of the engine 6 of the middle unit 5M. In this situation, the imaginary middle remote control lever 14M is assumed to be at the calculated middle position.

In the illustrated orientation of the controller 13 shown in FIG. 3, for example, the right remote control lever 14R is at F-fully open position (forward full throttle condition) and the left remote control lever 14L is at a position between the completely closed and the fully open positions. At this time, the imaginary middle lever position to be calculated is the middle position between the right lever 14R and the left lever 14L obtained by dividing the space between the two levers 14R, 14L into two equal parts. In this example, it is near the F-completely closed position. Thus, in this case, thrusts and their directions of the outboard motors 5 are shown in FIG. 4 by arrows P. Thus, the hull 2 advances while turning round, in the direction of the arrow F.

In the embodiments described above, the middle point of the space between lever positions of the left and right remote control levers 14L, 14R is selected as the position of the imaginary middle lever 14M, and the middle unit 5M is controlled on the assumption that a middle remote control lever 14M for controlling the middle unit 5M were actually at the middle point. Thus, the intermediate watercraft propulsion units can be used more effectively as compared with when a middle watercraft propulsion unit is always set in neutral when the outer units are in opposite drive modes, or when a middle unit is synchronized only with the left unit or right unit, as in the prior art. In addition, the difference in thrust between the left and right units, for example, at the time of head turning is not increased excessively by the thrust of the intermediate watercraft propulsion unit and an approximate thrust is given in the advancing direction of one watercraft propulsion unit, providing a craft control without any awkward feeling.

Figure 5:
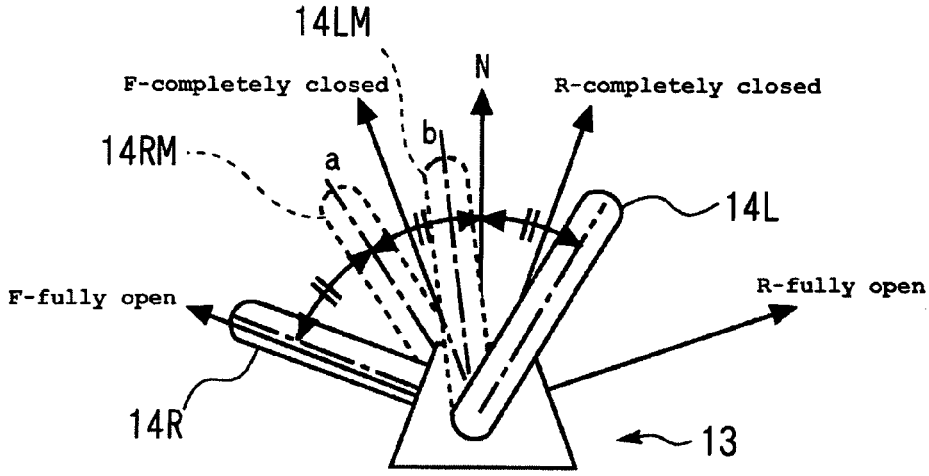
FIG. 5 is a schematic side elevational view of a modification of the controller of FIG. 3.
Figure 6:
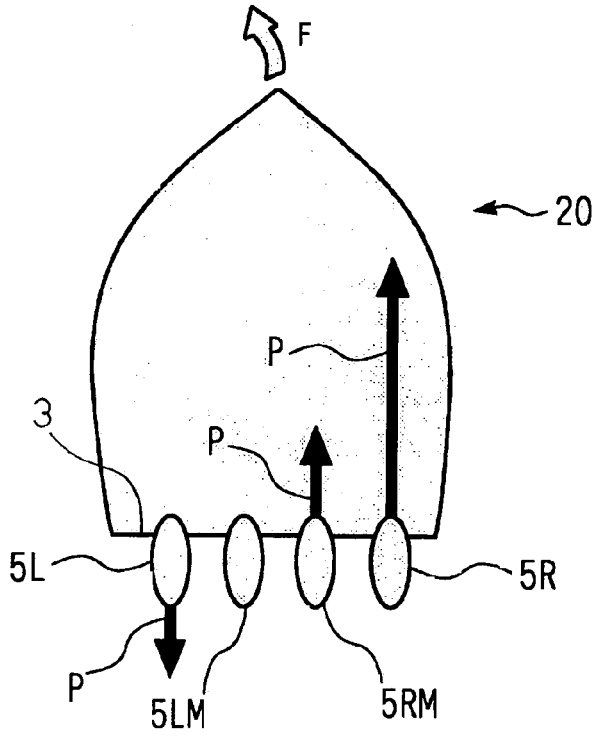
FIG. 6 is a schematic top plan view of the watercraft including the controller of FIG. 5 and illustrating an exemplary but non-limiting operation thereof.

Although the foregoing embodiment is an example in which this invention is applied to a watercraft 1 of a three-unit type, the method of driving middle units according to these inventions can also be applied to a watercraft provided with three or more outboard motors. FIG. 5 and FIG. 6 are illustrations of the control of an outboard motor for a watercraft of a four-unit type as a variation of the above embodiments, FIG. 5 shows a controller, and FIG. 6 shows a watercraft provided with four propulsion units controlled by the controller. Like parts are designated by the like reference numerals as in the first embodiment.

As shown in FIG. 6, in this case a watercraft 20 has four outboard motors mounted in parallel on a transom plate 3, and these outboard motors are referred to as a left unit 5L, a left-middle unit 5LM, a right-middle unit 5RM, and a right unit 5R in due order from the left. A lever 14L shown in FIG. 5 by a solid line is the left remote control lever for the shift change and opening adjustment (thrust control) of the throttle valve 8*a* of the left unit 5L, and a lever 14R, the right remote control lever for the shift change and opening adjustment (thrust control) of the throttle valve 8*a* of the right unit 5R. An imaginary lever 14 LM shown in FIG. 5 by a dotted line governs the operation of the left-middle unit 5LM, and imaginary lever 14 RM governs the operation of the right-middle unit 5RM.

In this variation, the control circuit 17 (FIG. 2) reads lever positions of the left and right remote control levers 14L, 14R, and further in its calculation section 17*a*, the lever rotation range between two lever positions is divided into three equal parts. The imaginary lever 14LM governing the control of the left-middle unit 5LM is assumed to be at an equally-divided position, of the three equally-divided positions, near the left remote control lever 14L. On the other hand, the imaginary lever 14RM governing the control of the right-middle unit 5RM is assumed to be at an equally-divided position, of the three equally-divided positions, near the right remote control lever 14R. The control circuit 17 outputs drive signals corresponding to the imaginary levers 14LM and 14RM to the engines 6 in the left-middle unit 5LM and the right-middle unit 5RM.

In the controller 13 shown in FIG. 5, for example, the right remote control lever 14R is at a position near F-fully open one and the left remote control lever 14L is at a position between R-completely closed and R-fully open positions near R-completely closed position. Therefore, drive signals for the left-middle unit 5LM and the right-middle unit 5RM to be calculated are set on the assumption that the left-middle imaginary lever 14LM governing the control of the left-middle unit 5LM were actually at a position between neutral (N) and F-completely close ones, and the right-middle imaginary lever 14RM governing the control of the right-middle unit 5RM were actually at a position between F-completely closed and F-fully open ones. Thus, magnitudes and directions of the thrusts of the outboard motors 5L, 5LM, 5RM and 5R are shown in FIG. 6 by arrows P. Thus, the hull 20 advances while turning round, in the direction of the arrow F.

In the foregoing variation, the positions obtained by dividing the lever rotation range between lever positions of the left and right remote control levers 14L, 14R, are selected as positions of the imaginary levers 14LM and 14RM, for the drive-control of the left-middle unit 5LM and the right-middle unit 5RM.

Figure 7:
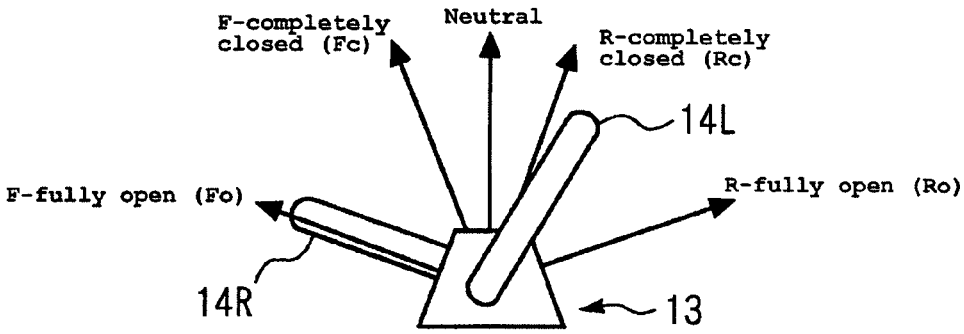
FIG. 7 is a schematic side elevational view of another modification of the controller of FIG. 3.
Figure 8:
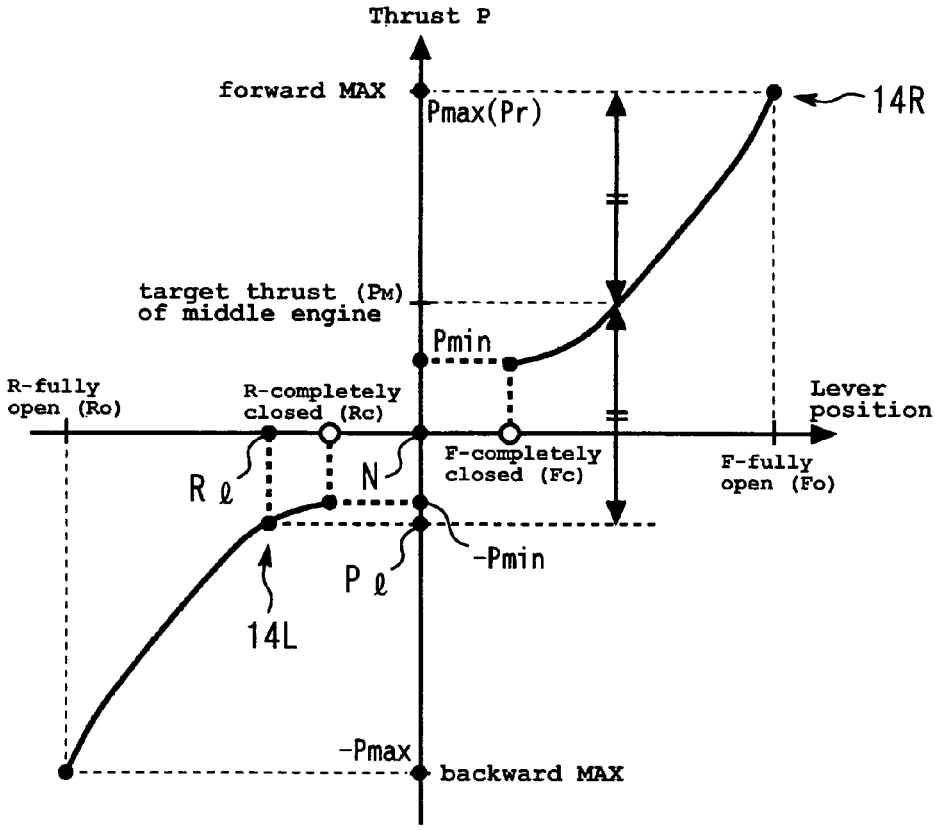
FIG. 8 is a diagram showing exemplary but non-limiting relationships between lever position and thrust of the operating device according to the modification of FIG. 7.

FIG. 7 and FIG. 8 are illustrations of other embodiments that can be used for controlling middle propulsion units. In these embodiments, unlike the foregoing ones, the thrust of the intermediate outboard motors is calculated from thrusts corresponding to the two levers without need of assuming the imaginary lever. Like parts are designated by the like reference numerals as in the first embodiments.

FIG. 7 shows an ordinary controller 13, and FIG. 8 shows the relation between lever position of the remote control lever of the controller 13 and engine thrust corresponding to the lever position. In FIG. 8, the engines have zero thrust when the remote control lever is at a position between F-completely closed position Fc and R-completely close position Rc including neutral position (N), that is, the shift falls in the neutral range, and operates to generate a minimum forward thrust of Pmin when the remote control lever is at F-completely closed position Fc. Also, the engine operates to generate a minimum backward thrust of—Pmin when the remote control lever is at R-completely closed position Rc. By the way, in FIG. 8, the thrust has a positive value when the hull moves forwardly and it has a negative value when the hull moves backwardly.

In the second embodiment, as in the first embodiment, the control circuit 17 (FIG. 2) reads lever positions of the left and right remote control levers 14L, 14R, calculates for the engine of the left unit 5L, a thrust corresponding to the lever position of the left remote control lever 14L in the calculation section 17*a* and outputs a drive signal corresponding to that thrust. The control circuit calculates for the engine of the right unit 5R, a thrust corresponding to the lever position of the right remote control lever 14R and outputs a drive signal corresponding to that thrust. The control circuit calculates for the engine of the middle unit 5M, a value equal to half of the sum of the two thrust of the left unit 5L and the right unit 5R, as a target thrust of the middle unit 5M and outputs a drive signal corresponding to the target thrust.

In the controller 13 shown in FIG. 7, for example, the right remote control lever 14R is at F-fully open position Fo (in a forward full throttle condition) and the left remote control lever 14L is at a position between R-completely closed position Rc and R-fully open position Ro. Therefore, the engine of the right unit 5R (FIG. 4) is controlled to generate a thrust of Pr (=Pmax) corresponding to the right remote control lever position Fo in FIG. 8. On the other hand, the engine of the left unit 5L (FIG. 4) is controlled to generate a thrust of P1 (where P1<0) corresponding to the left remote control lever position R1 shown in FIG. 8. A target engine thrust of the middle unit 5M is calculated to be a value (Pmax+P1)/2 equal to exact half of the sum of thrust Pr and thrust P1 and the engine will be driven by the thrust PM shown in FIG. 8.

As described above, in these embodiments, the control circuit 17 calculates a value equal to half of the sum of engine thrusts corresponding to lever positions of the left and right remote control levers 14L, 14R and outputs, using this value as the target thrust, a drive signal to the calculation section of the engine in the middle unit 5M. Therefore, calculation itself is simple and can be practiced relatively easily. In addition, unlike the case where the drive of the middle unit 5M is completely matched (or "synchronized") to the drive of the left unit 5L or the right unit 5R, the middle unit 5M is driven using as a target the midvalue PM of the thrusts P1 and Pr of the left unit 5L and the right unit 5R shown in FIG. 8, so that when directions of the thrusts of the left unit 5L and the right unit 5R are opposite from each other during turning, for example, the thrust PM of the middle unit 5M can be calculated properly according to the thrusts of the left and right outboard motors, providing a craft control without any awkward feeling.

Regarding the thrust, it may be calculated on the assumption that thrust equals, or is proportional to, engine speed, for example. In this case, engine speeds of the left unit 5L and the right unit 5R are detected, engine speed of the middle unit 5M is calculated based on the detected data, and drive control is performed to obtain the engine speed, using the calculated engine speed as a target thrust.

Alternatively, in place of the engine speed (or in addition to the engine speed), the thrust may be calculated using the detected data of throttle opening or the amount of intake air.

Figure 9:
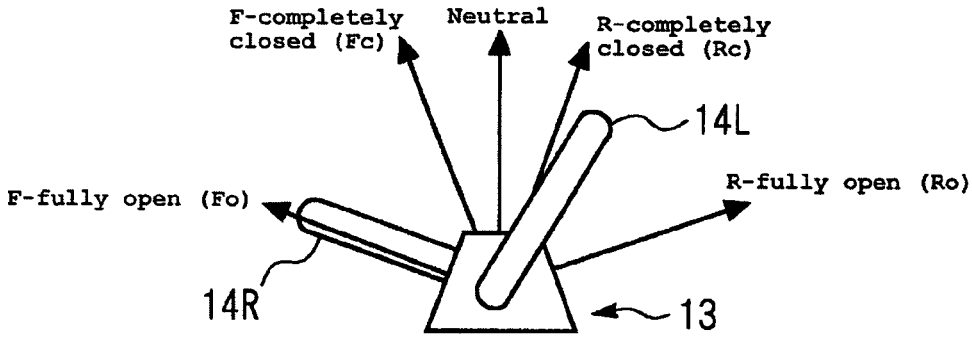
FIG. 9 is a schematic side elevational view of a modification of the controller of FIG. 7.
Figure 10:
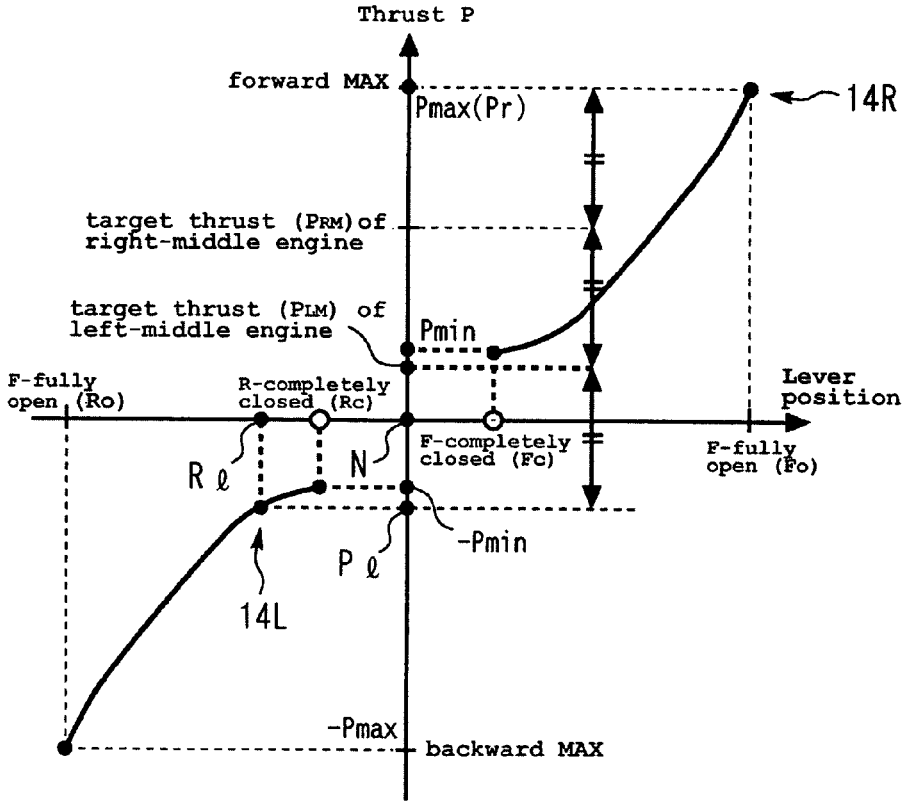
FIG. 10 is a diagram showing exemplary but non-limiting relationships between lever position and thrust of the operating device according to the modification of FIG. 9.

FIG. 9 and FIG. 10 illustrate an example of a thrust setting technique for outboard motors in a watercraft of four-unit type. FIG. 9 shows the controller 13, and FIG. 10 shows the relation between lever position of the remote control lever of the controller 13 and engine thrust corresponding to the lever position. The watercraft provided with four outboard motors drive-controlled by the controller 13 is the same as that of FIG. 6. Like parts are designated by like reference numerals as in the second embodiment.

In this variation, as in the embodiments described above with reference to FIGS. 7 and 8, first the control circuit 17 (FIG. 2) reads lever positions of the left and right remote control levers 14L, 14R, calculates for the engine of the left unit 5L, a thrust P1 corresponding to the lever position of the left remote control lever 14L in the calculation section 17*a* and outputs a drive signal corresponding to the thrust P1. On the other hand, the control circuit calculates for the engine of the right unit 5R, a thrust Pr corresponding to the lever position of the right remote control lever 14R and outputs a drive signal corresponding to the thrust Pr.

Further, the control circuit 17 divides the difference between two thrusts of the left unit 5L and the right unit 5R into three equal parts. Then, a thrust, of the three equally-divided thrust differences, near the engine thrust of the left unit 5L is set as the target value PLM the engine of the left-middle unit 5LM, and a thrust, of the three equally-divided thrust differences, near the engine thrust of the right unit 5R is set as the target value PRM for the engine of the right-middle unit 5RM. The control circuit 17 outputs drive signals corresponding to the target thrusts PLM and PRM to the engines of the left-middle unit 5LM and the right-middle unit 5RM, respectively.

In the controller 13 shown in FIG. 9, for example, the right remote control lever 14R is at F-fully open position Fo (in a forward full throttle condition) and the left remote control lever 14L is at a position between R-completely closed position Rc and R-fully open position Ro. Therefore, the engine of the right unit 5R (FIG. 6) is controlled to generate a thrust of Pr (=Pmax) corresponding to the right remote control lever position Fo in FIG. 10. On the other hand, the engine of the left unit 5L (FIG. 6) is controlled to generate a thrust of P1 (in this case, P1<0) corresponding to the left remote control lever position R1 of FIG. 10. Target engine thrusts of the right-middle unit 5RM and the left-middle unit 5LM are two thrust values PRM, PLM obtained by dividing the difference between thrust Pr and thrust P1 into three equal parts, and the control circuit 17 outputs a drive signal corresponding to the target thrust value PRM to the engine of the right-middle unit 5RM, and a drive signal corresponding to the target thrust value PLM to the engine of the left-middle unit 5LM.

As described above, since in this variation, two thrust values obtained by dividing the difference between engine thrusts P1 and Pr into three equal parts, are set as the target thrusts of the left-middle unit 5LM and the right-middle unit 5RM, calculation itself is simple and can be practiced relatively easily. In addition, the right-middle unit 5RM are driven using as target thrusts the two values between the thrust P1 of the left unit 5L and the thrust Pr of the right unit 5R, so that when directions of the thrusts of the left unit 5L and the right unit 5R are opposite from each other during turning, for example, thrusts of the left-middle unit 5LM and the right-middle unit 5RM can be calculated properly according to the thrusts of the left and right outboard motors, providing a watercraft control without any awkward feeling.

Figure 11:
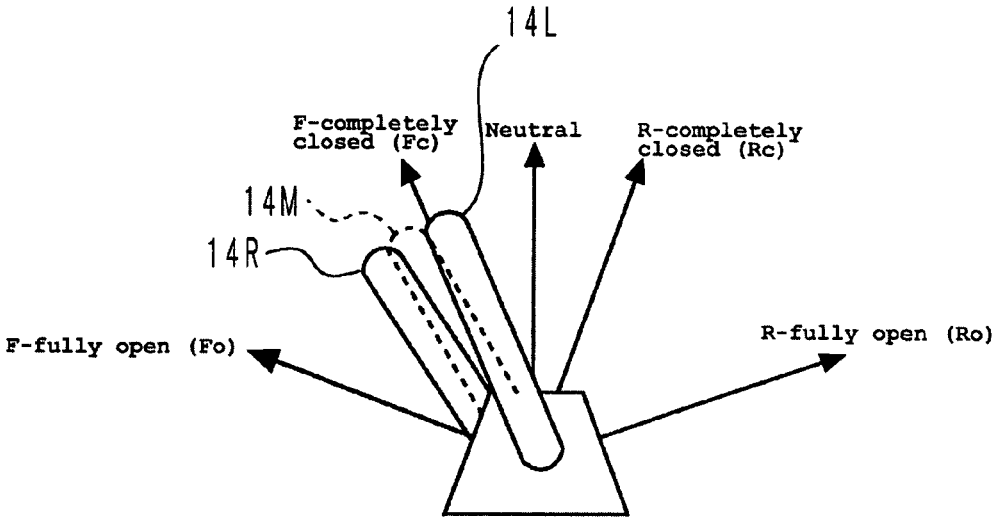
FIG. 11 is a schematic side elevational view of yet another modification of the controller of FIG. 3.
Figure 12:
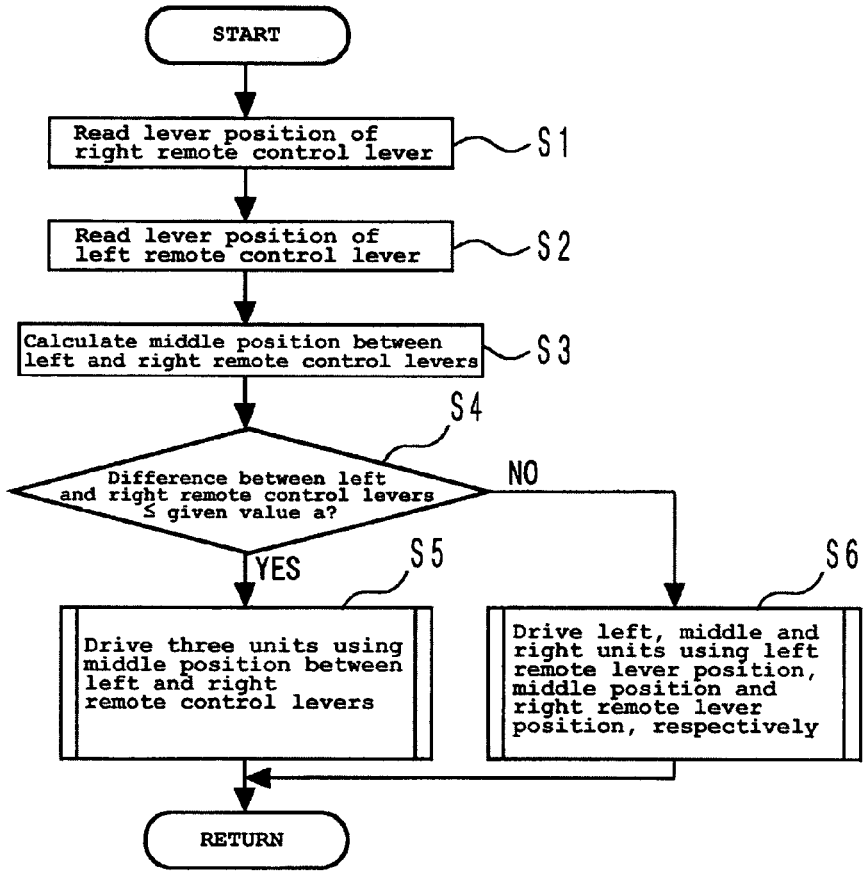
FIG. 12 is a flowchart illustrating a method than can be used in conjunction with the controller of FIG. 11.
Figure 13:
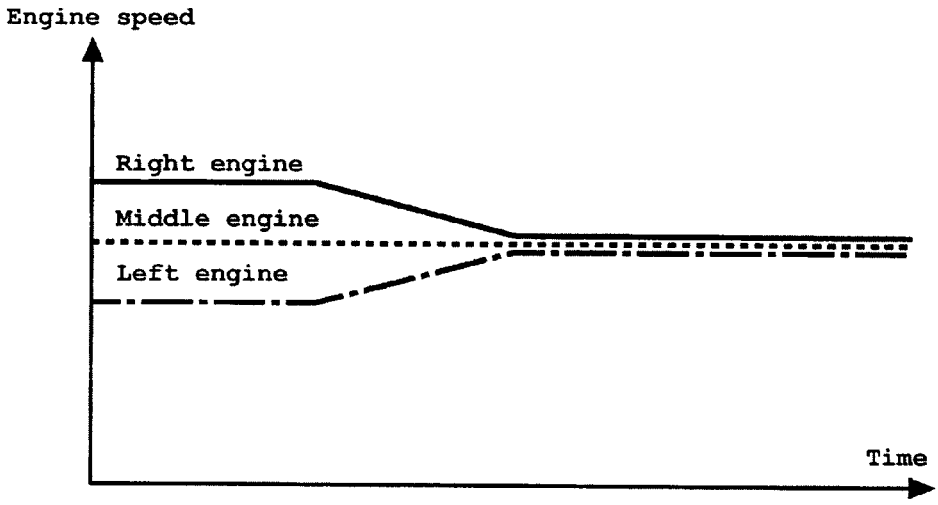
FIG. 13 is a diagram showing exemplary but non-limiting relationships between changes in engine speed and time where the controller of FIG. 11 is utilized.

FIG. 11, FIG. 12 and FIG. 13 show further embodiments. In these embodiments, the embodiments in which control of three outboard motors are performed are extended further. A watercraft provided with three outboard motors as the object of the present embodiments, can be the same as that of FIG. 4.

FIG. 11 shows a condition of the controller 13 to which the present embodiment are applied, FIG. 12 is a flowchart showing a procedure carried out by the control circuit 17 (FIG. 2), and FIG. 13 shows changes in engine speed over time of the engines controlled by the control circuit 17.

For example, when the left and right remote control levers 14L, 14R are at positions close to each other, as shown in FIG. 11, since the corresponding left and right units 5L, 5R are driven at engine speeds close to each other, some times an unpleasant noise may be produced around the hull due to the small engine speed difference, often generating a pulsating sound. In the these embodiments, for the purpose of reducing the unpleasant noise, the engine speeds of the left and right units 5L, 5R can be matched with the engine speed of the middle unit 5M.

FIG. 12 is a flowchart used for carrying out the foregoing engine control and a program to be executed can be stored in a memory (not shown) in the control circuit 17, as a routine to be carried out at given intervals, for example.

Step S1 can include reading the position of the right remote control lever 14R. Step S2 can include reading the position of the left remote control lever 14L.

Step S3 can include calculating a middle position between the left and right remote control levers 14L, 14R (assumption of the middle remote control lever 14M). Step S4 can include determining the positional difference between the left and right remote control levers 14L, 14R and judging whether or not it is no larger than a predetermined value a. If it is not larger than the specified value a, the procedure is judged to be Yes and then the process can proceed to step S5. If it is larger than the specified value, the procedure is judged to be No and the process can proceed to step S6.

Step S5 can include driving the left unit 5L and the right unit 5R together with the middle unit 5M using the middle lever position determined at the step S3. As a result, in the engines of the right unit 5L and the left unit 5R which have been driven corresponding to the lever positions of the right remote control lever 14R and the left remote control lever 14L, their drive targets are changed to a target corresponding to the position of the middle remote control lever 14M and the engine speeds of the three machines agree with each other (see FIG. 13).

Step S6 can include the same control as described above in which the middle unit driven in accordance with the middle position of the levers 14L, 14R. That is, the left unit 5L is driven corresponding to the position of the left remote control lever 14L, and the right unit 5R corresponding to the position of the right remote control lever 14R. The middle unit 5M is driven corresponding to the position of the middle imaginary remote control lever 14M assumed at the step S3.

As described above, since in the these embodiments, positions of the left and right remote control levers are read at all times and when the difference between their lever positions is small, all three engines of the outboard motors are driven at an engine speed matched with that of the middle unit 5M, unpleasant noise due to the minute difference in engine speed can be reduced effectively.

Alternatively, engine speeds of the left and right engines are determined in place of the lever positions of the left and right levers, throttles of the left and right engines may be controlled to be matched with the throttle of the middle engine when the engine speed difference is no larger than a given value.

Although the present inventions have been described in the context of the various embodiments, the number of outboard motors is not limited to three or four outboard motors. Rather, these inventions can also be applied to a watercraft carrying more than three outboard motors. For example, in the case of a watercraft carrying N outboard motors, lever positions (or thrusts) obtained by dividing the space between the lever positions of the left and right remote control levers (or the thrust difference between the left and right engines) into (N−1) equal parts, may be assigned to the engines of the intermediate outboard motors.

As for application of the present inventions, shift control and throttle control are possible with two levers without any awkward feeling not only in the watercraft but also in the other vehicles of the type with a plurality of engines disposed in parallel (for example, such as a hovercraft and the like).

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A watercraft control system for controlling shift and thrust of watercraft propulsion units through first and second adjacent operating levers in a watercraft having at least a left-most propulsion unit, a right-most propulsion unit, and at least an intermediate propulsion unit disposed between the right-most and the left-most propulsion units, the control system comprising a control device configured to detect positions of the first and second operating levers, to control the operation of the left-most propulsion unit in response to the lever position of the first lever, and to control the operation of the right-most propulsion unit in response to the lever position of the second lever, wherein the control device includes a calculation module for calculating, from the detected lever positions, imaginary lever positions of the intermediate watercraft propulsion units between the left and the right units.

2. The watercraft control system according to claim 1, wherein the watercraft has only three watercraft propulsion units, and the imaginary lever position is calculated as a middle point of the space between lever positions of the first and second operating levers.

3. The watercraft control system according to claim 1, wherein the watercraft has at least four watercraft propulsion units and the imaginary lever positions of two of the watercraft propulsion units between the left-most and right-most propulsion units, are two equally-divided lever positions obtained by dividing the space between the first and second lever positions into three equal parts.

4. The watercraft control system according to claim 1, wherein if the difference between the first and second operating lever positions is not larger than a predetermined value, the right-most and left-most propulsion units are controlled so as to generate the same thrust, together with the intermediate watercraft propulsion unit, corresponding to an intermediate position between the first and second lever positions.

5. A watercraft control system for controlling shift and thrust of watercraft propulsion units through first and second adjacent operating levers in a watercraft having a left-most propulsion unit, a right-most propulsion unit, and at least an intermediate propulsion unit disposed between the right-most and the left-most propulsion units, the control system comprising control means for detecting lever positions of the first and second operating levers, controlling the left-most propulsion unit in response to the position of the first lever, and controlling the right-most unit in response to the position of the second operating lever, wherein the control means includes calculation means for calculating, from the detected lever positions, imaginary lever positions of the intermediate watercraft propulsion units between the left and the right units.

6. A watercraft control system for controlling shift and thrust of watercraft propulsion units through first and second adjacent operating levers in a watercraft having a left-most propulsion unit, a right-most propulsion unit, and at least an intermediate propulsion unit disposed between the right-most and the left-most propulsion units, the control system comprising a control device configured to detect lever positions of the first and second operating levers, to control the left-most propulsion unit in response to the position of the first lever, and to control the right-most unit in response to the position of the second operating lever, wherein the control device includes a calculation device configured to detect a thrust of the left-most unit and a thrust of the right-most unit and to calculate, from the detected thrusts of the left-most and right-most units, target thrusts of the intermediate propulsion unit between the left unit and the right unit thrusts.

7. The watercraft control system according to claim 6, wherein the watercraft has three watercraft propulsion units, and wherein the target thrust is a thrust equal to half of the sum of the thrust of the right unit and that of the left unit.

8. The watercraft control system according to claim 6, wherein the watercraft has four propulsion units and the target thrusts of the two intermediate propulsion units are two equally-divided thrusts obtained by dividing the difference between the thrust of the right-most unit and that of the left-most unit into three equal parts.

9. A watercraft control system for controlling shift and thrust of watercraft propulsion units through first and second adjacent operating levers in a watercraft having a left-most propulsion unit, a right-most propulsion unit, and at least an intermediate propulsion unit disposed between the right-most and the left-most propulsion units, the control system comprising control means for detecting lever positions of the first and second operating levers, controlling the left-most propulsion unit in response to the position of the first lever, and controlling the right-most unit in response to the position of the second operating lever, wherein the control device includes calculation means for detecting a thrust of the left-most unit and a thrust of the right-most unit and calculating, from the detected thrusts of the left-most and right-most units, target thrusts of the intermediate propulsion unit between the left unit and the right unit thrusts.

* * * * *

UNITED STATES PATENT AND TRADEMARK OFFICE

CERTIFICATE OF CORRECTION

PATENT NO. : 7,121,908 B2
APPLICATION NO. : 11/187136
DATED : October 17, 2006
INVENTOR(S) : Takashi Okuyama It is certified that error appears in the above-identified patent and that said Letters Patent is hereby corrected as shown below:

On the Title page (56), Col. 2 (Other Publications), Line 2, please delete "I600" and insert --i600--, therefor.

At col. 7, line 9-11, please delete "FIG. 6 shows a watercraft…..in the first embodiment." And insert the same after "and" on line 8.

At col. 8, line 42, after "of", please delete "P1" and insert --Pl--, therefor.

At col. 8, line 42, after "(where", please delete "P1" and insert --Pl--, therefor.

At col. 8, line 43, please delete "R1" and insert --Rl--, therefor.

At col. 8, line 45, please delete "P1)/2" and insert --Pl)/2--, therefor.

At col. 8, line 46, please delete "P1" and insert --Pl--, therefor.

At col. 8, line 59, please delete "P1" and insert --Pl--, therefor.

At col. 9, line 22, please delete "P1" and insert --Pl--, therefor.

At col. 9, line 24, please delete "P1." and insert --Pl.--, therefor.

At col. 9, line 33, after "PLM", please insert --for--.

At col. 9, line 50, after "of", please delete "P1" and insert --Pl--, therefor.

At col. 9, line 50, after "case", please delete "P1" and insert --Pl--, therefor.

At col. 9, line 51, please delete "R1" and insert --Rl--, therefor.

At col. 9, line 54, please delete "P1" and insert --Pl--, therefor.

At col. 9, line 62, please delete "P1" and insert --Pl--, therefor.

At col. 9, line 67, please delete "P1" and insert --Pl--, therefor.

At col. 10, line 56, after "unit" insert --is--.

UNITED STATES PATENT AND TRADEMARK OFFICE

CERTIFICATE OF CORRECTION

PATENT NO. : 7,121,908 B2
APPLICATION NO. : 11/187136
DATED : October 17, 2006
INVENTOR(S) : Takashi Okuyama It is certified that error appears in the above-identified patent and that said Letters Patent is hereby corrected as shown below:

At col. 11, line 22, after “also in”, please delete “the”.

Signed and Sealed this

Twenty-sixth Day of August, 2008

JON W. DUDAS
*Director of the United States Patent and Trademark Office*